US006217071B1

(12) United States Patent
Shia

(10) Patent No.: US 6,217,071 B1
(45) Date of Patent: Apr. 17, 2001

(54) SKI LIFT SKI REST

(76) Inventor: Steven S. Shia, 4444 North Ave. #2, San Diego, CA (US) 92116-3950

( * ) Notice: Subject to any disclaimer, the term of this patent is extended or adjusted under 35 U.S.C. 154(b) by 0 days.

(21) Appl. No.: 09/520,093

(22) Filed: Mar. 8, 2000

(51) Int. Cl.[7] ..... A63C 11/00
(52) U.S. Cl. ..... 280/809
(58) Field of Search ..... 280/814, 809; 294/147

(56) References Cited

U.S. PATENT DOCUMENTS

| | | | | |
|---|---|---|---|---|
| 4,013,318 | * | 3/1977 | Piper | 280/809 |
| 4,531,661 | * | 7/1985 | Santy | 280/814 |
| 4,852,931 | * | 8/1989 | Ferdi | 280/814 |
| 5,335,835 | * | 8/1994 | Hogan | 280/814 |
| 5,951,048 | * | 9/1999 | Slaughter | 280/814 |

FOREIGN PATENT DOCUMENTS

| | | | | |
|---|---|---|---|---|
| 227612 | * | 2/1943 | (CH) | 280/809 |
| 0676328 | * | 1/1991 | (CH) | 280/814 |

* cited by examiner

*Primary Examiner*—Brian L. Johnson
*Assistant Examiner*—Elaine Gort
(74) *Attorney, Agent, or Firm*—John D. Gugliotta

(57) ABSTRACT

The invention is an apparatus that serves as a foot rest for ski lift chairs. The invention is designed to take stress off of the leg and back areas of the rider by providing them a place to rest their feet. The user simply fastens a nylon strap with a quick release buckle around the safety bar or arm rest of the ski lift chair. From the nylon strap, a cord hangs down where it connects to a harness supporting a foldable foot rest. Each segment of the foot rest folds thru an arc to provide a flat foot rest area that is approximately ten inches long. Each foot rest extension is connected thru its pivot point with a long screw. The screw, along with washers and nuts, also serves to fasten the foot rest to the harness. The user then rests his or her ski boot on the foot rest for the ride to the top of the ski slope. In an alternate preferred embodiment, a snow board harness is substituted for the cord, harness and foldable foot rest.

6 Claims, 7 Drawing Sheets

SKI LIFT SKI REST

RELATED APPLICATIONS

There are no previously filed, nor currently any co-pending applications, anywhere in the world.

BACKGROUND OF THE INVENTION

1. Field of the Invention

The present invention relates generally to ski equipment and, more particularly, to an apparatus for supporting a skier's skis while riding a ski lift.

2. Description of the Related Art

Among the many wintertime outdoor recreation and leisure activities that many people enjoy, skiing still remains one of the all time favorites. It can be enjoyed by people of all skill levels and all ages. One activity usually associated with skiing is that of riding a ski lift to the top of a ski run. This is often a relaxing procedure and gives the riders an opportunity to wave to friends, enjoy the scenery and watch other skiers. However, on those ski lifts without an integral foot rest, it can turn into a painful experience for many. The constant tension of the skis, the boots, and clothing pulling down on ones legs without any support can cause pain, stress, and tension in the leg, knee, and back muscles. This fact may keep some people from enjoying skiing altogether and at the very least keeps people from skiing longer. Accordingly, there exists a need for a means by which the comfort of a foot rest can be provided to ski lift chairs without an integral foot rest. The development of the ski lift ski rest fulfills this need.

In the related art, there exists several patents for devices for supporting the skier's feet and skis while riding a ski lift chair. Most of these devices support the feet and skis by providing a support suspended from a single cord or line connected to a strap that is secured to the user's waist or to the ski lift chair. However, when a support strap is secured to a user's waist, the user bears the weight of the feet and skis, which can be very uncomfortable. The devices in the patents wherein the strap is connected to the ski lift chair can be cumbersome and difficult to attach to the ski lift chair for support. The present invention eliminates all of these problems by providing a ski lift ski rest that is supported by the safety rail of the ski lift and not by the user and is connected via convenient quick release clamps.

A search of the prior art did not disclose any patents that read directly on the claims of the instant invention; however, the following references were considered related:

| U.S. Pat. No. | Inventor | Issue Date |
|---|---|---|
| 5,653,467 | Griffin et al. | Aug. 5, 1977 |
| 4,940,255 | Donine | Jul. 10, 1990 |
| 5,261,699 | Marston | Nov. 16, 1993 |
| 4,358,138 | Laughlin et al. | Nov. 9, 1982 |
| 4,341,400 | Morgan | Jul. 27, 1982 |
| 4,299,409 | Gedicks | Nov. 10, 1981 |
| 4,844,547 | Adkins | Jul. 4, 1989 |
| 4,556,252 | Serex | Dec. 3, 1985 |

Consequently, a need has been felt for providing an improved ski lift ski rest which is easily and quickly attached to the ski lift safety rail and is not supported by the user.

SUMMARY OF THE INVENTION

It is therefore an object of the present invention to provide a foot rest for ski lift chairs not equipped with one.

It is another object of the present invention to provide riders a place to rest the feet.

It is yet another object of the present invention to reduce strain, stress, and tension on the back, leg and knee areas.

It is yet still another object of the present invention to allow riders to ski longer.

It is a feature of the present invention to provide an improved nylon strap that attaches to the safety bar, arm rest or just about anything on ski lift chair.

It is another feature of the present invention to provide an improved nylon strap that attaches quickly and easily with a quick release clamp.

It is yet another feature of the present invention to be easily removed at the top of ride.

It is yet still another feature of the present invention to provide a folding foot rest that folds small for compact storage in jacket pocket.

It is an advantage of the present invention that it can be used on all styles of ski lifts.

It is an advantage of the present invention that it can be rented to skiers or purchased.

It is a benefit of the present invention that it makes for a more enjoyable outing.

It is another benefit of the present invention that an alternate preferred embodiment can be used to support the feet of a snowboard.

Briefly described according to one embodiment of the present invention, the ski lift ski rest, as its name implies, is an apparatus that serves as a foot rest for ski lift chairs. It is designed to take stress off of the leg and back areas of the rider by providing them a place to rest their feet. The user simply fastens a nylon strap with a quick release buckle around the safety bar or arm rest of the ski lift chair. From the nylon strap, a nylon cord hangs down where it connects to a "Y" shaped harness. The ends of the harness connect to each side of a foldable foot rest extension. Each extension folds thru an arc to provide a flat foot rest area that is approximately ten inches long. Each foot rest extension is connected thru its pivot point with a long screw. The screw, along with washers and nuts, also serves to fasten the abovementioned harness. The user then rests his or her ski boot and ski on the foot rest for the ride to the top of the ski slope. At the top, the rider quickly removes the invention, folds it up, and secures it in a pocket for the ski trip back down. The use of the invention removes the stress and strain on ones legs and feet hanging in mid-space without support for long time periods. Such support is a relief to one's back, leg, ankle, and knee areas. The use of the ski lift ski rest provides foot support on ski lifts that are not equipped with foot rests in a temporary manner that is quick, easy and effective.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

10 Ski Lift Ski Rest
15 Foot Rest
15*a* Left Foot Rest
15*b* Right Foot Rest
15*c* Foot
15*d* Aperture
15*e* Hub
16 Bolt
17 Washer
18 Nut
20 Harness
30 Cord
30*a* Upper Loop
30*b* Lower Loop
31 Safety Cord
31*a* Belt Clip
40 Support Strap
40*a* Clamp Clip
40*b* Clamp Socket
50 Carrying Case

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
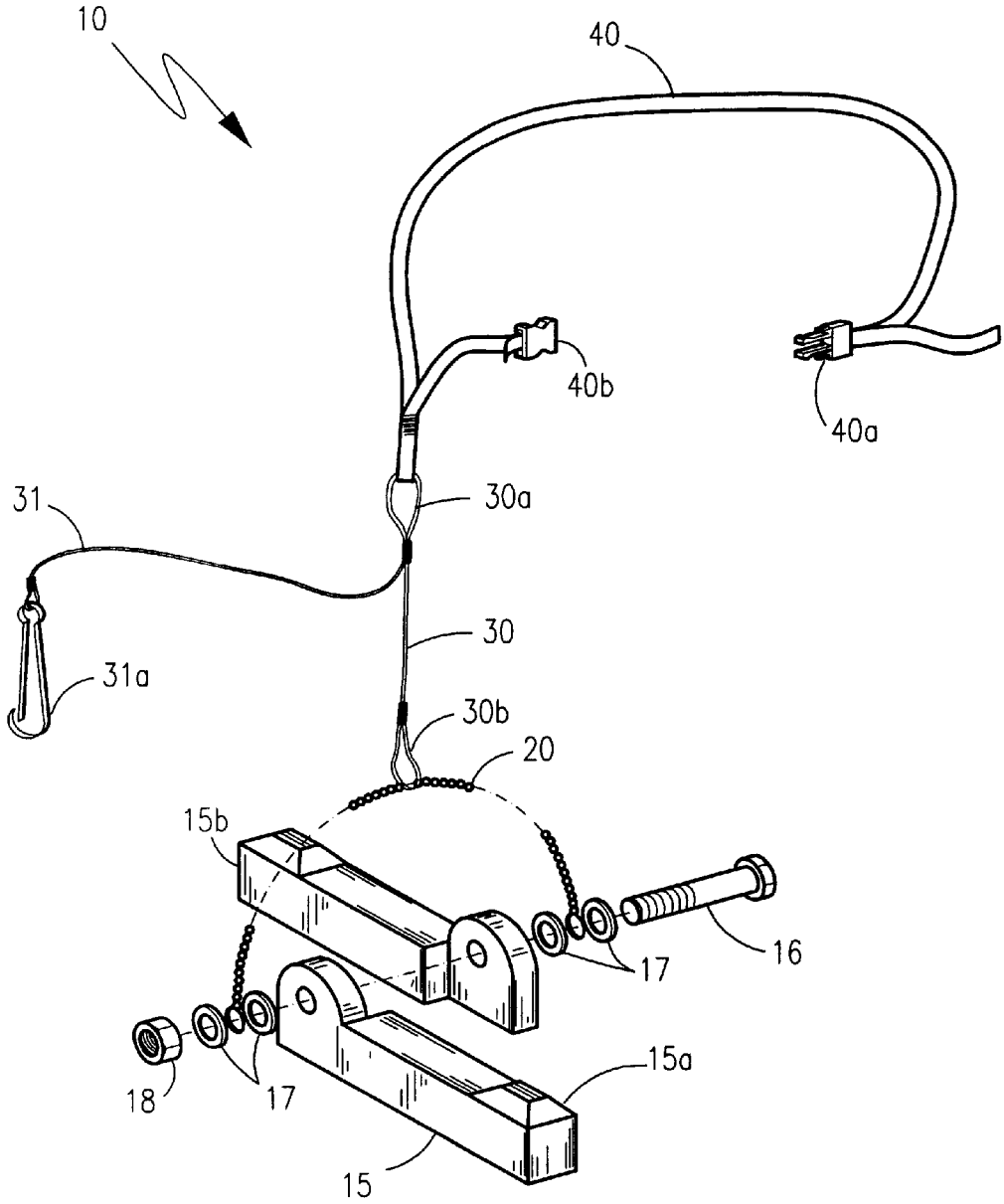
FIG. 1 is a perspective view of a ski lift ski rest, according to the preferred embodiment of the present invention.
Figure 2:
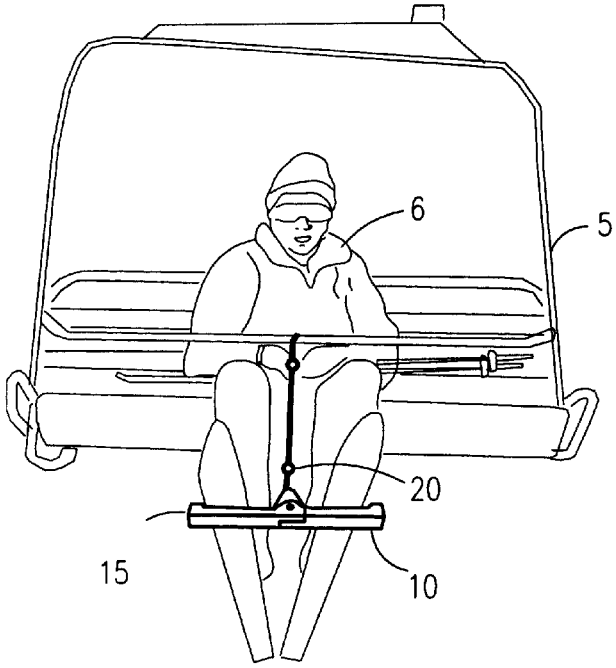
FIG. 2 is a front perspective view of a ski lift ski rest, in the intended usage with a skier on a ski lift, according to the preferred embodiment of the present invention.
Figure 3:
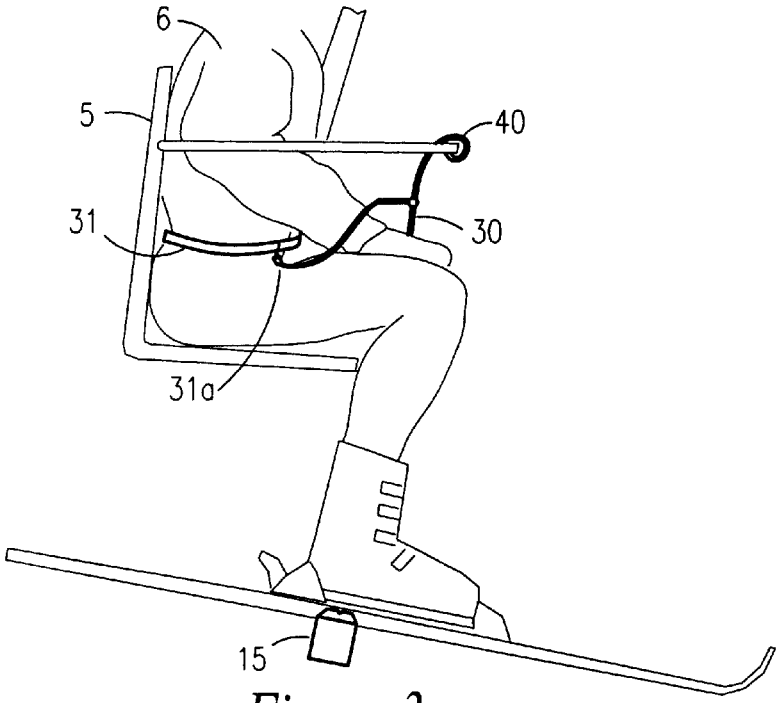
FIG. 3 is a side view of a ski lift ski rest in the intended usage with a skier on a ski lift, according to the preferred embodiment of the present invention.

Referring now to FIG. 1, a ski lift ski rest is shown, according to the present invention, for use on a conventional ski lift to provide a support where a skier may rest their skis and feet while riding a ski lift. The device 10 is designed to be portable and carried in a special carrying case around the skier's waist. When a skier enters a ski lift chair the device 10 is removed from the carrying case. The foot rest 15 is unfolded so that the right foot section 15*a* and left foot section 15*b* are linearly aligned. Right foot section 15*a* and left foot section 15*b* are pivotally connected together at one end by a hub 15*e* formed on the end of right foot section 15*a* and left foot section 15*b*. Hub 15*e* has an aperture 15*d* formed in the center for receiving a bolt 16 which holds the two hubs 15*e* and 15*d* together as well as acting as a pivot pin. Before bolt 16 is inserted into apertures 15*d*, a washer 17 is placed on bolt 16 followed by loop on the first end of harness 20, followed by another washer 17. Harness 20 can be any linearly elongated cord having a loop secured to both a first end and a second end. In the preferred embodiment shown in FIG. 1, harness 20 is fashioned from small link chain and the loop at each end at the end link of the chain. Bolt 16 is now inserted through apertures 15*d* with the threaded end now receiving a washer 17 followed by loop from the second end of harness 20, another washer 17, and finally nut 18. Nut 18 is of the self locking type to prevent it from unbolting during use. A cord 30 is connected to the center of harness 20 by a second loop 30*b* on the lower end of cord 30. Cord 20 is generally a high strength nylon cord or equivalent. The upper end of cord 30 is formed into a loop 30*a* for receiving the lower end of supporting strap 40. Supporting strap 40 is a nylon or fabric web strap as is commonly found with sporting equipment and the like. A safety cord 31 is also attached to loop 30*a* for the purposes discussed herein below. The upper end of support strap 40 is secured to the safety rail of the ski lift 5 by wrapping the webbing around the safety rail and securing the ends by inserting clamp clip 40*a* into socket 40*b* of quick release clamp 40. Quick release clamp 40 is of the type for securing web strapping together and allowing the length of the webbing to be adjusted. Foot rest 15 is now suspended from the ski lift safety rail via harness 20, cord 30, and support strap 40. Safety cord 31 is secured to skier's belt around the waist of skier 6 via a belt clip 31 a as shown in FIG. 3. Should support strap 40 fail, safety cord 31 will prevent foot rest 15 from plunging to the ground below.

Figure 4:
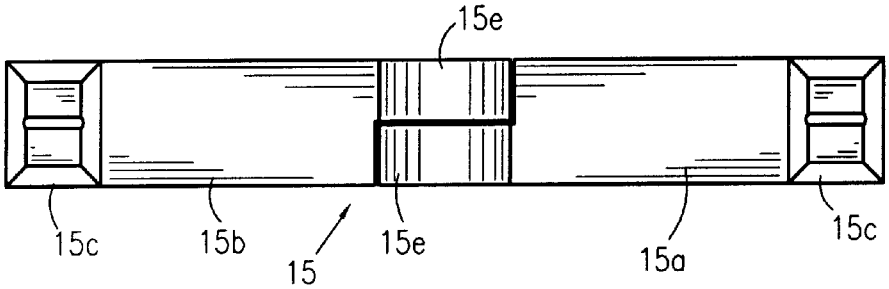
FIG. 4 is a top view of a foot rest from a ski lift ski rest, according to the preferred embodiment of the present invention.
Figure 5:
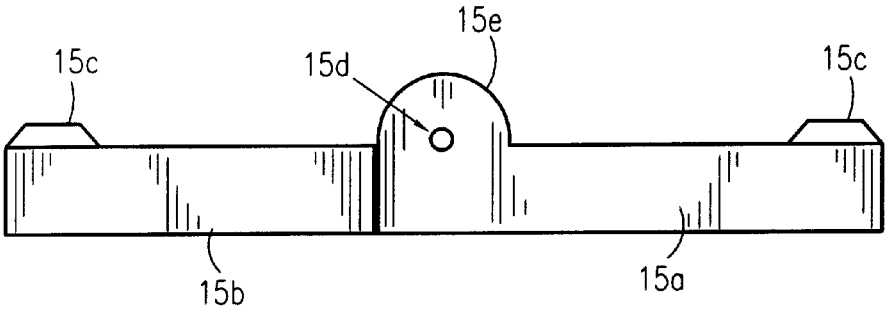
FIG. 5 is a side view of a foot rest from a ski lift ski rest, according to the preferred embodiment of the present invention.
Figure 6:
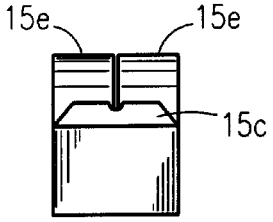
FIG. 6 is an end view of a foot rest from a ski lift ski rest, according to the preferred embodiment of the present invention.

Referring now to FIGS. 4 through 6, a foot rest 15 is shown comprised of a right foot 15*a* and a left foot 15*b*. Right foot 15*a* and left foot 15*b* are pivotally connected together at one end via a hub 15*e* formed on right foot 15*a* and left foot 15*b*. A foot 15*c* is formed on the opposite end of right foot 15*a* and left foot 15*b*. Foot 15*c* is to provide a guide to prevent the skier's ski from slipping off the 15 ends of right foot 15*a* and left 15*b*. Right foot 15*a* and left foot 15*b* are generally elongated rectangular shaped pieces of lightweight aluminum or plastic formed and cut as described. Right foot 15*a* and left foot 15*b* are approximately 5" in length although the final dimensions may vary upon further testing and design. All materials and dimensions are merely suggestions and in no way imply any limitation on the final specifications of the device 10.

Figure 7:
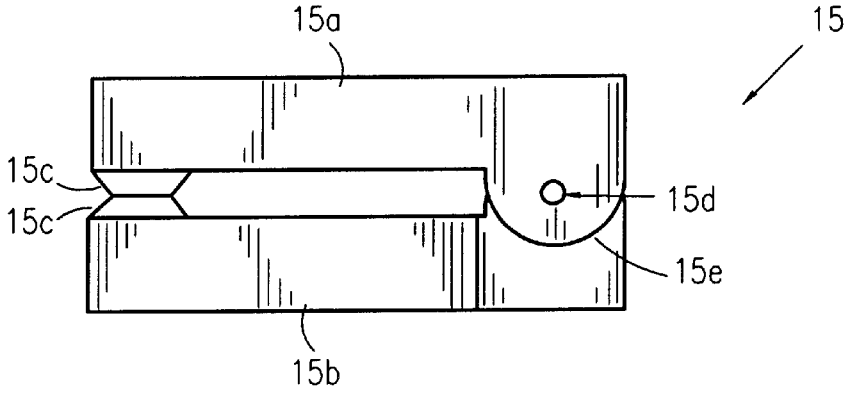
FIG. 7 is a side view of a foot rest from a ski lift ski rest in the folded configuration, according to the preferred embodiment of the present invention.
Figure 8:
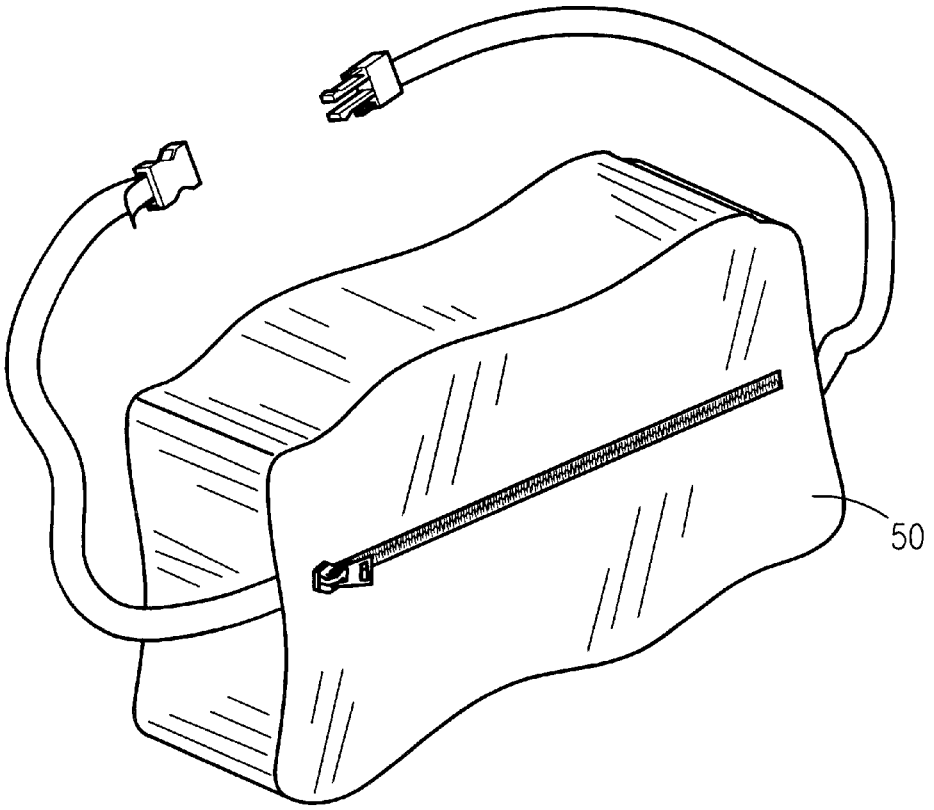
FIG. 8 is a perspective view of a carrying case for a ski lift ski rest, according to the preferred embodiment of the present invention.
Figure 9:
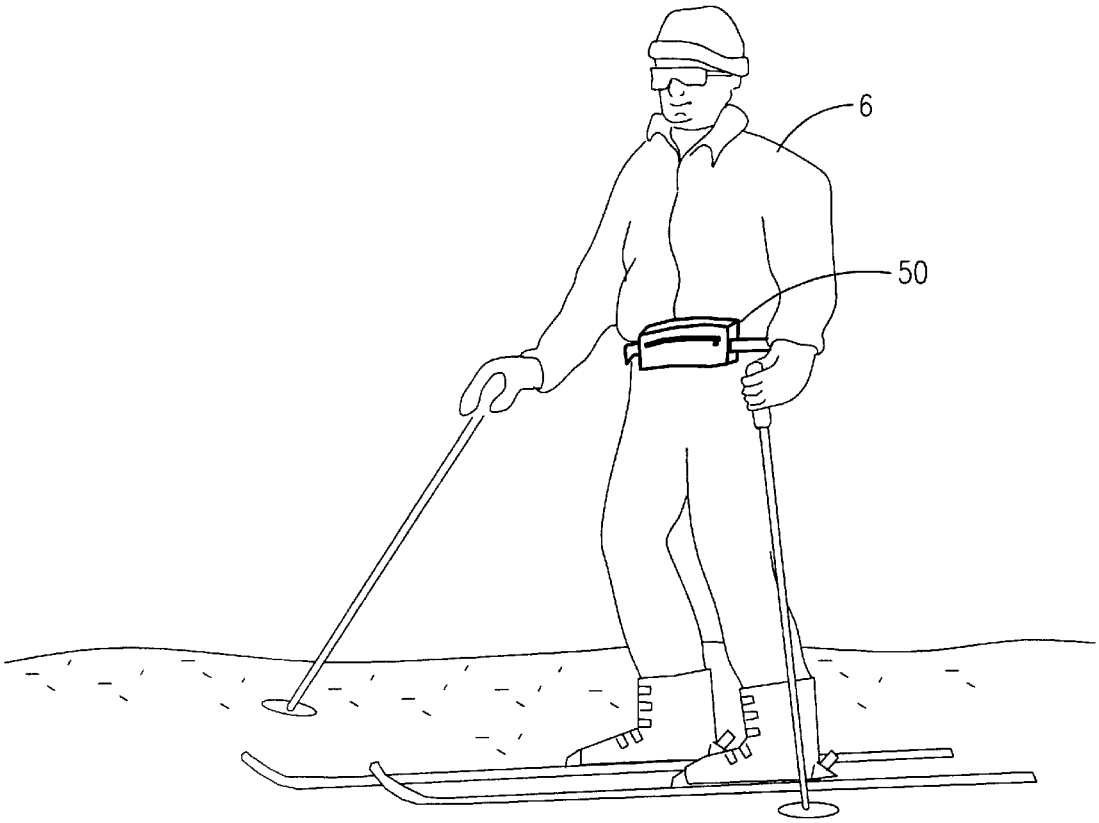
FIG. 9 is a side perspective view of a ski lift ski rest being carried in a carrying case around the waist of a skier, according to the preferred embodiment of the present invention.

Referring now to FIGS. 7 and 8, shown is the foot rest 15 in the folded configuration for ease of storage and transport. Right foot 15*a* folds over on top of left foot 15*b* so that the feet on the opposite ends face each other. The device 10 along with harness 20, cord 30 safety cord 31, and support strap 40 are then inserted into carrying case 50. Carrying case 50 is a leather or vinyl zippered case with a carrying strap for securing carrying case 50 around the waist of the user as shown in FIG. 9.

Figure 10:
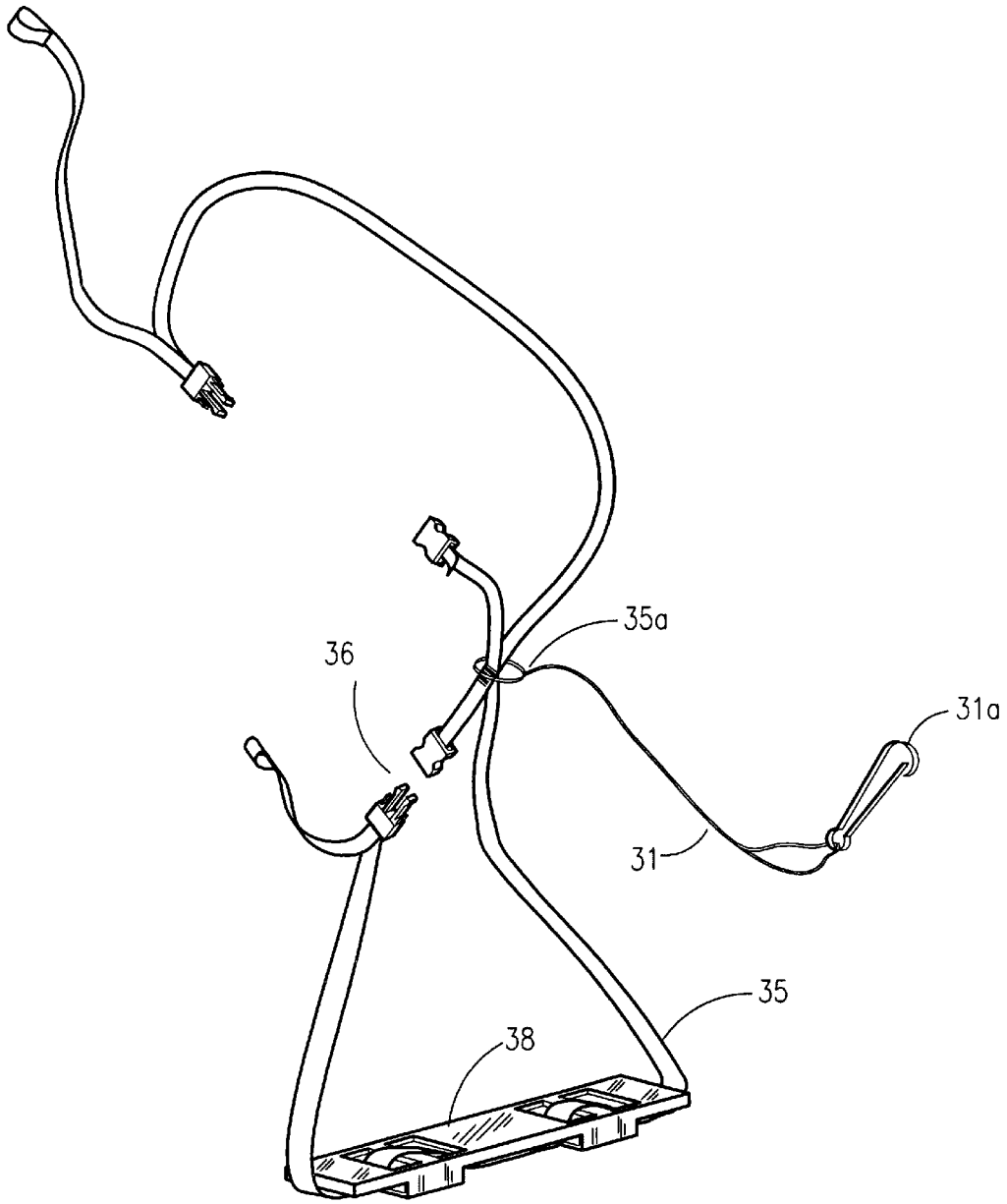
FIG. 10 is a front perspective view of a snow board foot rest, according to the preferred alternate embodiment of the present invention.
Figure 11:
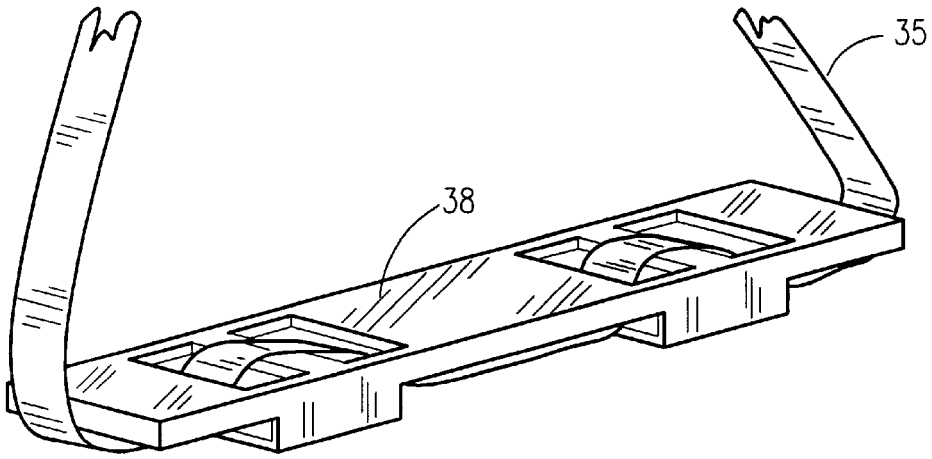
FIG. 11 is a front perspective view of the strap pad portion located along the bottom edge of the suspension harness of the snow board foot rest, according to the alternate preferred embodiment of the present invention.

In an alternate preferred embodiment as shown in FIGS. 10–11, foot rest 15, harness 20, and cord 30 are replaced with a snow board support harness 35. One end of the snow board support harness 35 is connected to the lower end of support strap 40. A safety cord 31 is attached at a first end to loop 35*a*. Connected to the second end of safety cord 31 is a belt clip 31*a* for attaching safety cord 31 to the belt of the snow boarder. In this fashion, should support strap 40 break snowboard harness 35 and the snow board resting thereon will not plunge to the ground below. Support strap 40 is secured to the safety rail of the ski lift as heretofore described. Snow board support harness 35 is constructed from the same webbing material as support strap 40. Snow board support harness 35 is generally triangular in shape and is adjustable in size via an adjustable quick release clamp 36. Quick release clamp 36 also allows one side of the snow board support harness 35 to be temporarily separated to allow for easier storage as well as for inserting the snow board into the interior therein. Located along the bottom leg portion of the triangle shaped snow board support harness 35 is a strap pad 38 for providing a surface wherein the snow board may be rested upon as well as functioning as a stiffener of the bottom leg portion of snow board support harness 35. Strap pad 38 is of a rectangular cross section having a hollow interior wherein the webbing of snow board support harness 35 is threaded therethrough. Strap pad 38 is adjusted so that it lays on the bottommost central portion of snow board support harness 35.

2. Operation of the Preferred Embodiment

To use the present invention, a skier normally enters and seats themselves on the chair of a ski lift. The safety bar of the chair is lowered if so equipped. The ski poles are then slid under the skier's legs to free their hands. The invention is then removed from the carrying case. The carrying case is normally strapped to the front of the waist of a skier for convenience, ease of use and transport. A special support strap is unwound and then held tight by the skier. A safety cord connected to the skier's belt, and a support strap is placed around the ends of the ski poles. While holding the strap, the attached foot support is unfolded and allowed to dangle between the user's skis. The foot support is then placed beneath the skis and then the pulled upward by the skier via the strap. The strap is then secured to the safety rail of the ski lift with the quick release clamps provided. Slack is removed from the strap by adjusting the length of the strap through adjustments on the quick release clamp. One end of a cord is connected to the support strap while the opposite end is connected to a harness which is connected to the foot rest. In this fashion, the weight of the skis can be supported by the rail of the ski lift through the harness, cord, and supporting strap. A safety cord connected to the cord prevents the foot rest from falling to the ground should the support strap fail. The safety cord is secured to the belt of the skier through the use of a special belt clip. Once at the top of the hill, the support strap is released from the safety bar via the quick release clamp and the safety cord disconnected from the belt of the skier by the belt clip. The foot rest is folded together and the entire assembly is replaced in the carrying case.

The alternate preferred embodiment snow board attachment is utilized in a similar fashion. As before, the support strap is secured to the safety rail via quick release clamps. However, a special snow board support harness is attached to the support strap instead of a cord and a folding foot rest. The supporting harness has a single bar wherein the snow board may be inserted and supported. Once the skier places the snow board onto the bar, slack may be taken up in the support strap via adjustments in the quick release clamps and the support strap secured. The weight of the snow board is now supported by the support strap and harness.

The foregoing description is included to illustrate the operation of the preferred embodiment and is not meant to limit the scope of the invention. The scope of the invention is to be limited only by the following claims.

I claim:

1. A ski lift ski rest comprising:

a foot rest having a right foot section and a left foot section being linearly aligned with each other, said right foot section and said left foot section pivotally connected together at one end by a hub formed on the end of right foot section and left foot section, said hub having an aperture formed in the center for receiving a bolt which holds the two hubs together as well as acting as a pivot pin;

a harness having a first end and a second end, both said first end and said second end affixed about said bolt;

a supporting strap affixed to said harness; and a safety cord attached to said harness; and wherein the upper end of said support strap is adapted to be secured to the safety rail of a ski lift by wrapping said support strap around the safety rail and securing the support straps ends together.

2. The ski lift ski rest of claim 1, wherein said support strap has two opposed ends, one said end terminated by a clamp clip of a quick release clamp and the other said end terminated by a socket of a quick release clamp.

3. The ski lift ski rest of claim 1, wherein said safety cord is formed of a webbed nylon rope.

4. The ski lift ski rest of claim 1, wherein said support strap is formed of a webbed nylon rope.

5. The ski lift ski rest of claim 1, wherein said right foot section and said left foot section are each generally elongated rectangular shaped pieces of lightweight aluminum.

6. The ski lift ski rest of claim 1, wherein said right foot section and said left foot section are each generally elongated rectangular shaped pieces of plastic.

* * * * *